US007283953B2

(12) United States Patent
Fado et al.

(10) Patent No.: US 7,283,953 B2
(45) Date of Patent: Oct. 16, 2007

(54) PROCESS FOR IDENTIFYING EXCESS NOISE IN A COMPUTER SYSTEM

(75) Inventors: Frank Fado, Highland Beach, FL (US); Peter J. Guasti, Coral Springs, FL (US); Amado Nassiff, Boynton Beach, FL (US); Ronald E. Vanbuskirk, Indiantown, FL (US)

(73) Assignee: International Business Machines Corporation, Armonk, NY (US)

( * ) Notice: Subject to any disclaimer, the term of this patent is extended or adjusted under 35 U.S.C. 154(b) by 1105 days.

(21) Appl. No.: 09/399,873

(22) Filed: Sep. 20, 1999

(65) Prior Publication Data

US 2003/0120483 A1 Jun. 26, 2003

(51) Int. Cl.
*G10L 11/06* (2006.01)

(52) U.S. Cl. ..... 704/210; 704/233

(58) Field of Classification Search ..... 704/200, 704/201, 210, 226, 233, 235, 270; 379/22.08, 379/27.02, 27.03
See application file for complete search history.

(56) References Cited

U.S. PATENT DOCUMENTS 5,764,852 A * 6/1998 Williams ..... 704/243
6,249,757 B1 * 6/2001 Cason ..... 704/214
6,301,559 B1 * 10/2001 Shinotsuka et al. ..... 704/239
6,324,499 B1 * 11/2001 Lewis et al. ..... 704/233

FOREIGN PATENT DOCUMENTS

JP 410091184 A * 4/1998

* cited by examiner

*Primary Examiner*—Angela Armstrong
(74) *Attorney, Agent, or Firm*—Akerman Senterfitt

(57) ABSTRACT

The method of identifying excess noise in a computer system includes first recording a silence sample; second recording an isolated noise sample while operating a computer system component in isolation from other computer system components; comparing signal characteristics of the silence sample with signal characteristics of the isolated noise sample; and, attributing the isolated noise sample to the isolated computer component when the signal characteristics of the silence sample differ by a preset threshold from the signal characteristics of the isolated noise sample. The inventive method can further include logging the signal characteristics of the silence sample and the isolated noise sample; reporting excess noise identified in the identifying step; and, suggesting a remedy for the identified excess noise.

12 Claims, 4 Drawing Sheets

PROCESS FOR IDENTIFYING EXCESS NOISE IN A COMPUTER SYSTEM

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Technical Field

This invention relates to the field of computer speech recognition and more particularly to a method and system for identifying excess noise in a computer system.

2. Description of the Related Art

Speech recognition, also referred to as speech-to-text, is the technology that enables a computer to transcribe spoken words into computer recognized text equivalents. Speech recognition is the process of converting an acoustic signal, captured by a transductive element, such as a microphone or a telephone, to a set of words. These words can be used for controlling computer functions, data entry, and word processing. The process can be initiated by speaking into a microphone. The microphone can capture the sound waves and can convert them into electrical impulses. Subsequently, a sound card can convert the electrical impulses from an analog acoustic audio signal into a digital audio signal.

Excess noise can adversely affect applications that require clean audio signals to properly function. Speech recognition software expects to "hear" only the speaker's voice and not extraneous noises. Of course, noises exist everywhere, intermittent and continual. Consequently, speech recognition software often attempts to assess the level of background noise at the outset. Having measured the level of background noise, the speech recognition system can subtract the measured noise from the speaker's acoustic signal.

Generally, background noise can include external background noise and internal system noise. Sources of external background noise can include regular home or office noises—conversation, the radio, traffic, telephones, the consumption of snack foods, and the crumpling of paper. In contrast, sources of internal system noise can include the electronic components on the sound card, network interface adapter or the modem, the system power supply, the microphone, the motors in a floppy, hard or CD-ROM drive, the printer engine, the scanner engine, and electrical activity stemming from the use of the keyboard, speakers or mouse. Though both external noise and internal noise can detrimentally effect the operation of a computer audio system, because external noise typically includes sounds within the realm of the human auditory system, only external noise can be easily identified by human users. In contrast, human users cannot aurally identify internal noise. Moreover, because internal noise is inherently unrecognizable to the human user, internal noise in most instances goes undetected by the human user.

In present systems, engineers recognize the multitude of potential sources of internal system noise. In the case of 32 and 64 bit sound cards, for instance, cross-talk can occur between the excess number of components placed on the sound card. Notably, many users of 32 and 64 bit sound cards have experienced problems with reducing internal system noise. Also, engineers note that sound chips permanently built-in on the main circuit board, resulting from space restrictions and cost cutting, often lead to a high level of background noise. Also, on-board chip sets are notorious for picking up electronic noise, particularly in the presence of excess disk activity.

Notwithstanding, where a human user can identify a noise generating internal component of a computer system, the user can remove the noisy component and the corresponding detrimental effect of the noisy component. Alternatively, in recognizing internal noise, a human user can avoid the use of the noisy system in its entirety. In either event, the identification of internal noise and the corresponding remedial action can translate into more productive audio application usage for the user.

At least one present speech recognition system has incorporated rudimentary noise detection. Yet, where included, present noise detection systems measure only a gross signal-to-noise ratio, taking into account the computer system as a whole. Present noise detection systems cannot isolate the source of internal noise. Moreover, present noise detection systems are unable to identify specific computer system component sources of the internal noise, and consequently are unable to recommend a remedy for the identified internal noise. Finally, present systems perform an incomplete analysis resulting in a potentially inaccurate diagnosis of internal noise level. Typically, present systems assess the background noise once, during a setup sequence, and use this measurement throughout future dictation. As a result, the user may be unaware of changes in the background noise level. For example, if in a tested system an internal hard disk drive is a source of internal noise, but remains inactive during noise detection, the noise detection system would incorrectly conclude a "quieter" computer system than the system would conclude were the hard disk drive active during the same test. Thus, there exists a need for a noise detection system capable of exercising each potential source of internal noise in a computer system. Only a thorough noise detection system can properly diagnose existing levels of internal noise in a computer system.

SUMMARY OF THE INVENTION

The invention concerns a method and system for identifying excess noise in a computer system. The invention as taught herein has advantages over all known methods now used to identify excess noise, and provides a novel and nonobvious system, including apparatus and method, for identifying excess noise in a speech recognition system. The method of identifying excess noise in a computer system comprises the steps of recording a silence sample; recording an isolated noise sample while operating a computer system component in isolation from other computer system components; comparing signal characteristics of the silence sample with signal characteristics of the isolated noise sample; and, attributing the isolated noise sample to the isolated computer component when the signal characteristics of the silence sample differ by a preset threshold from the signal characteristics of the isolated noise sample.

The inventive method can further comprise the steps of logging the signal characteristics of the silence sample and the isolated noise sample; reporting excess noise identified in the identifying step; and, suggesting a remedy for the identified excess noise. To provide the user with a facility for the automated serial testing of a plurality of computer system components, the inventive method can also comprise the steps of creating a list of computer system components to be tested for excess noise; and, associating with each component in the list a corresponding method for testing the component for excess noise. Correspondingly, the second recording step can comprise, for each computer system component in the created list of computer system components to be tested for excess noise, second recording an isolated noise sample while operating each computer system component in the created list according to the corresponding method.

To accommodate the step of suggesting a remedy, the inventive method can comprise the steps of: creating a list of computer system components to be tested for excess noise; first associating with each component in the list a corresponding method for testing the component for excess noise; and, second associating with each component in the list a corresponding remedy for excess noise identified in the corresponding component. Once again, the second recording step can comprise, for each computer system component in the created list of computer system components to be tested for excess noise, second recording an isolated noise sample while operating each computer system component in the created list according to the corresponding method. Moreover, the suggesting step can comprise suggesting the corresponding remedy for the identified excess noise in each computer system component in the created list.

BRIEF DESCRIPTION OF THE DRAWINGS

There are presently shown in the drawings embodiments which are presently preferred, it being understood, however, that the invention is not limited to the precise arrangements and instrumentalities shown.

DETAILED DESCRIPTION OF THE INVENTION

Figure 1:
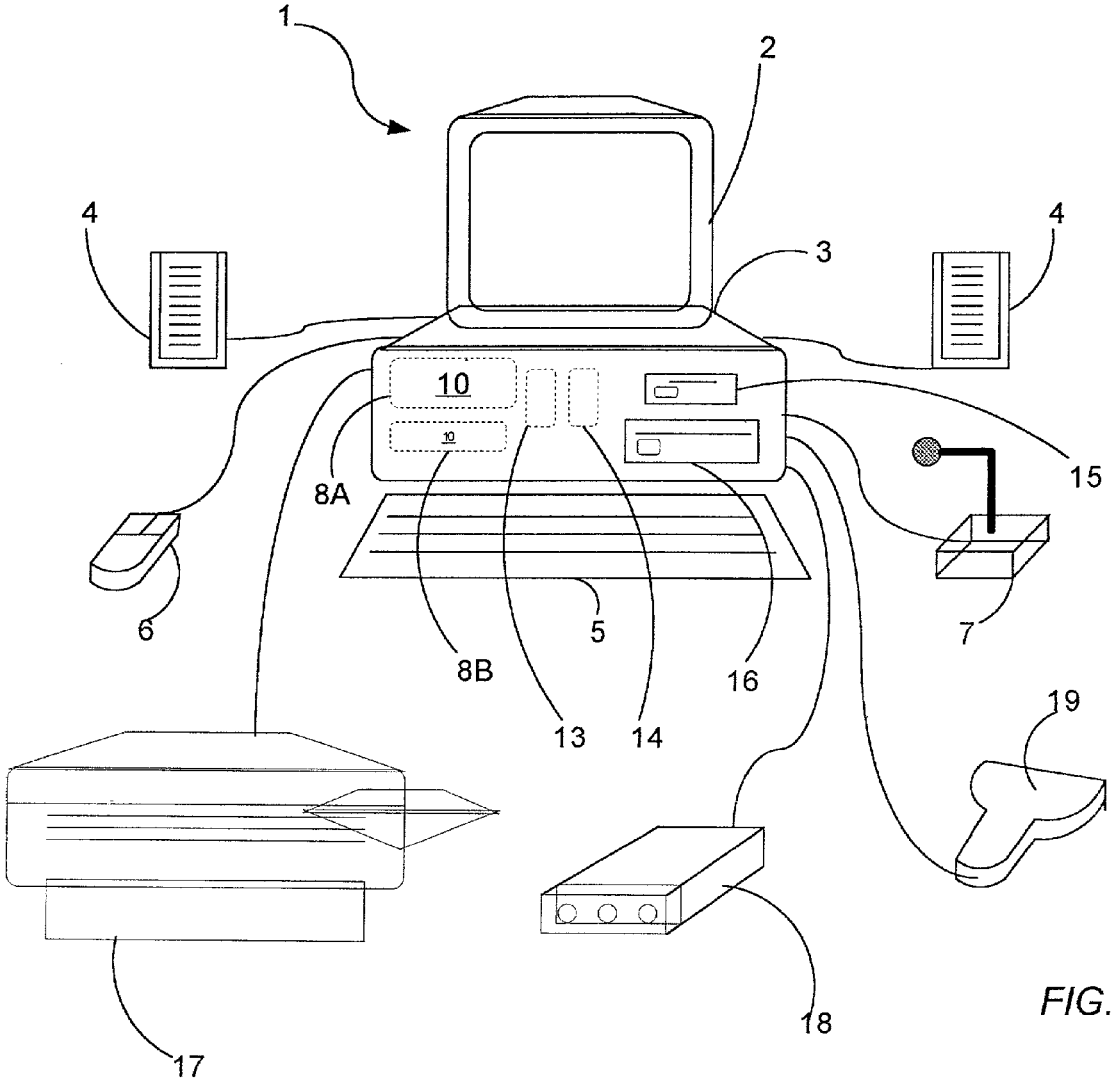
FIG. 1 is a pictorial representation of a computer system with audio capabilities on which the system of the invention can be used.

FIG. 1 shows a typical computer system 1 for use in conjunction with the present invention. The system preferably comprises a computer 3 having a central processing unit (CPU), fixed disk 8A, internal memory device 8B, floppy disk drive 15, and CD-ROM drive 16. The system also includes a microphone 7 operatively connected to the computer system through suitable interface circuitry or "sound board" 13, a keyboard 5, and at least one user interface display unit 2 such as a video data terminal (VDT) operatively connected thereto. The CPU can be comprised of any suitable microprocessor or other electronic processing unit, as is well known to those skilled in the art. An example of such a CPU would include the Pentium or Pentium II brand microprocessor available from Intel Corporation, or any similar microprocessor. Speakers 4, as well as an interface device, such as mouse 6, can also be provided with the system, but are not necessary for operation of the invention as described herein. The various hardware requirements for the computer system as described herein can generally be satisfied by any one of many commercially available high speed multimedia personal computers offered by manufacturers such as International Business Machines (IBM), Compaq, Hewlett Packard, or Apple Computers.

Computer system 1, as shown in FIG. 1, also can include a network interface card 14, operatively connected to the bus (not shown) of computer 3. As shown in the drawing, a communications modem 18 is connected externally to the serial port (not shown) of computer 3. In addition, laser printer 17 is attached to the parallel port (not shown) of computer 3. Finally, scanner 19 can be operatively connected to computer 3 using one of several generally accepted interfaces, for instance through the parallel port, an optional Small Computer Systems Interface port, a Universal Serial Bus port, or other proprietary method. One skilled in the art will recognize, however, that the methods and mechanisms of operatively connecting each peripheral component to the computer 3 can vary from system to system. In many cases, some peripheral components, for instance modem 18, can be operatively connected internally, directly to the system bus. Conversely, some internal components, for instance network interface card 14, can be connected externally, for instance, through the parallel port.

Figure 2:
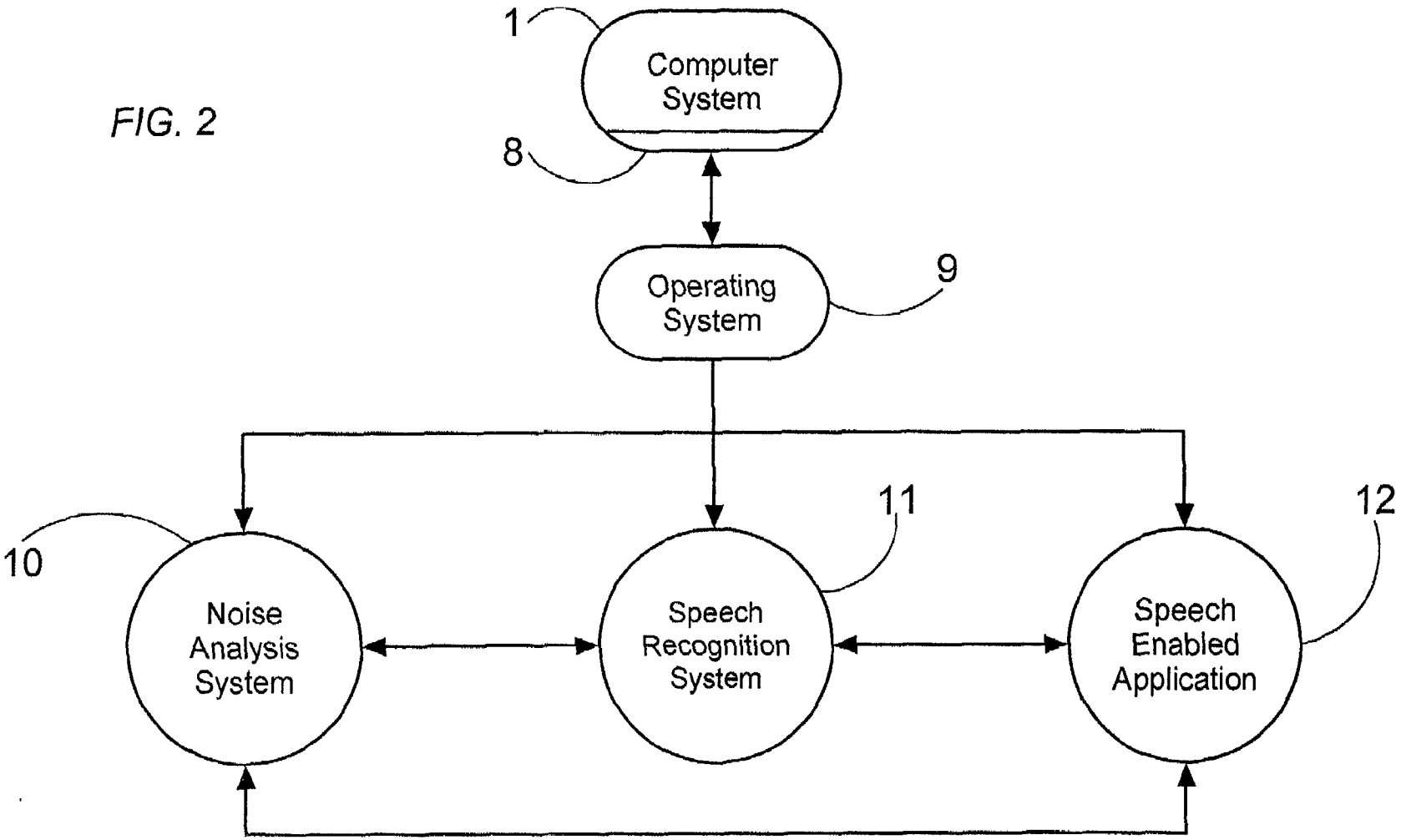
FIG. 2 is a block diagram showing a typical high level architecture for the computer system in FIG. 1.

FIG. 2 illustrates a preferred architecture for a speech recognition system in computer 1. As shown in FIG. 2, the system can include an operating system 9, a noise analysis system 10 in accordance with the inventive arrangements, and a speech recognition system 11. A speech enabled application 12 can also be provided. In FIG. 2, the noise analysis system 10, the speech recognition system 11, and the speech enabled application 12 are shown as separate application programs. It should be noted, however, that the invention is not limited in this regard, and these various applications could, of course, be implemented as a single, more complex applications program.

In a preferred embodiment described herein, operating system 9 is one of the Windows family of operating systems, such as Windows NT, Windows 95 or Windows 98 which are available from Microsoft Corporation of Redmond, Wash. However, the system is not limited in this regard, and the invention can also be used with any other type of computer operating system. The system as disclosed herein can be implemented by a programmer, using commercially available development tools for the operating systems described above. As shown in FIG. 2, computer system 1 includes one or more computer memory devices 8, preferably an electronic random access memory 8B and a bulk data storage medium, such as a fixed disk drive 8A.

Audio signals representative of sound received in microphone 7 are processed within computer 1 using conventional computer audio circuitry so as to be made available to operating system 9 in digitized form. The audio signals received by the computer 1 are conventionally provided to the speech recognition system 11 via the computer operating system 9 in order to perform speech recognition functions. As in conventional speech recognition systems, the audio signals are processed by the speech recognition system 11 to identify words spoken by a user into microphone 7. Using noise analysis system 10, the present invention can identify internal system noise stemming from the fixed disk drive 8A, CD-ROM drive 16, floppy disk drive 15, network interface card 14, modem 18, keyboard 5, mouse 6, printer 17, scanner 19, and speakers 4.

Figure 3:
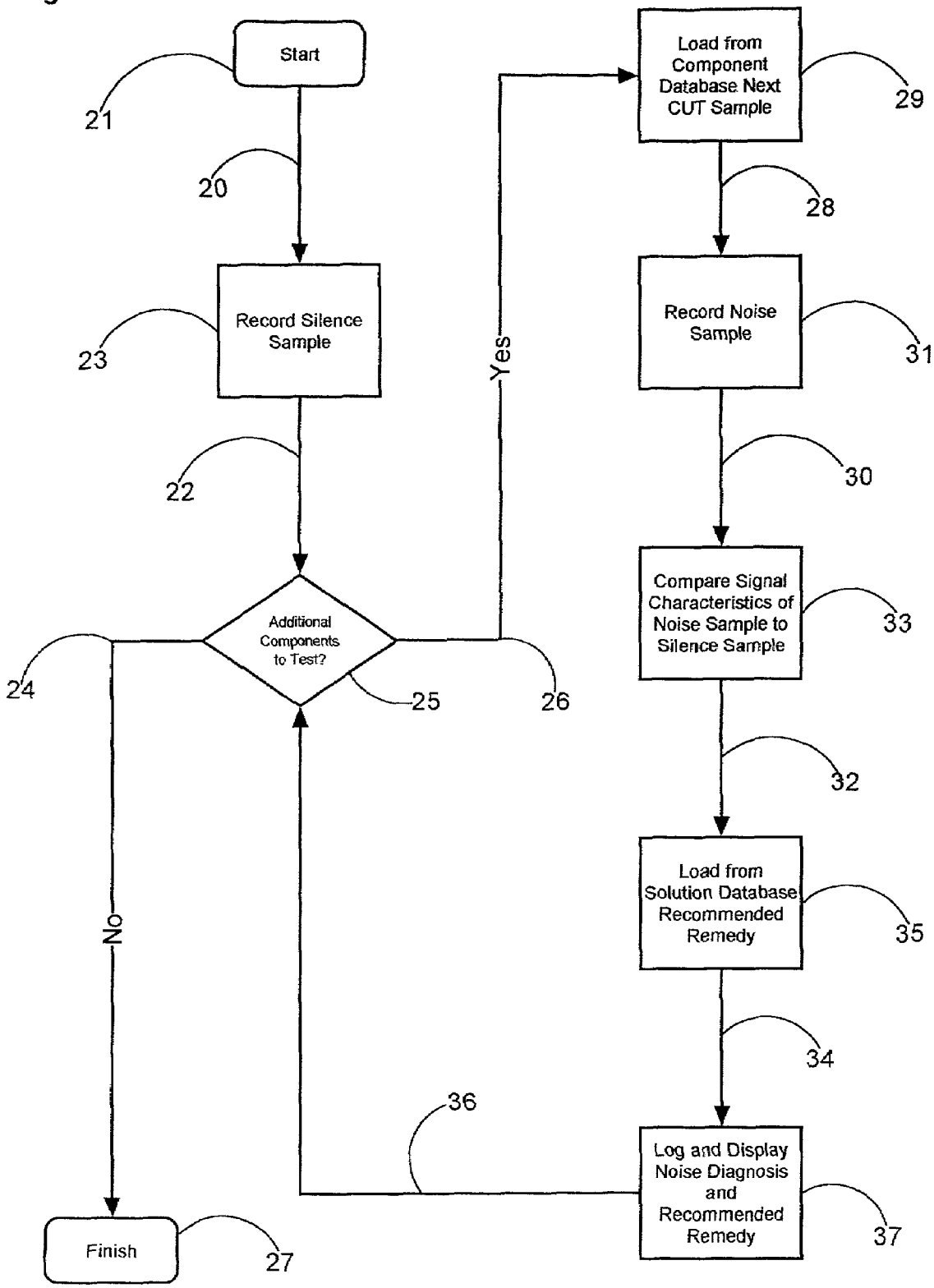
FIG. 3 is a flow chart illustrating a process for identifying excess noise in a computer system.

FIG. 3 is a flow chart illustrating a process for identifying excess noise in a computer system. The method begins in step 21, following path 20 to step 23. In step 23, the inventive method records an audio sample of external silence during a period of system inactivity. Following path 22 to decision block 25, the method preferably can determine if a database of component tests contains additional components to be tested for internal system noise. Following path 26, if at least one component remains to be tested, the method in step 29 will load from a database of component tests, the next component to be tested and the corresponding test. Following path 28 to step 31, the method will record a noise sample while operating the component under test (CUT) in accordance with the test loaded in step 29. In step 33, the inventive method preferably can compare the signal characteristics of the recorded noise sample with the signal characteristics of the silence sample, recorded in step 23.

Subsequently, in step 35, the inventive method preferably can search a database of remedies for a recommended remedy to any internal system noise detected in the CUT. Following path 34 to step 37, the inventive method preferably can log the results of the comparison of step 33 and can notify the user of any detected internal system noise and of any recommended remedy, found in step 35. Returning to decision block 25 along path 36, the process preferably repeats if untested components remain in the component tests database. Otherwise, the process terminates following path 24 to step 27.

Figure 4:
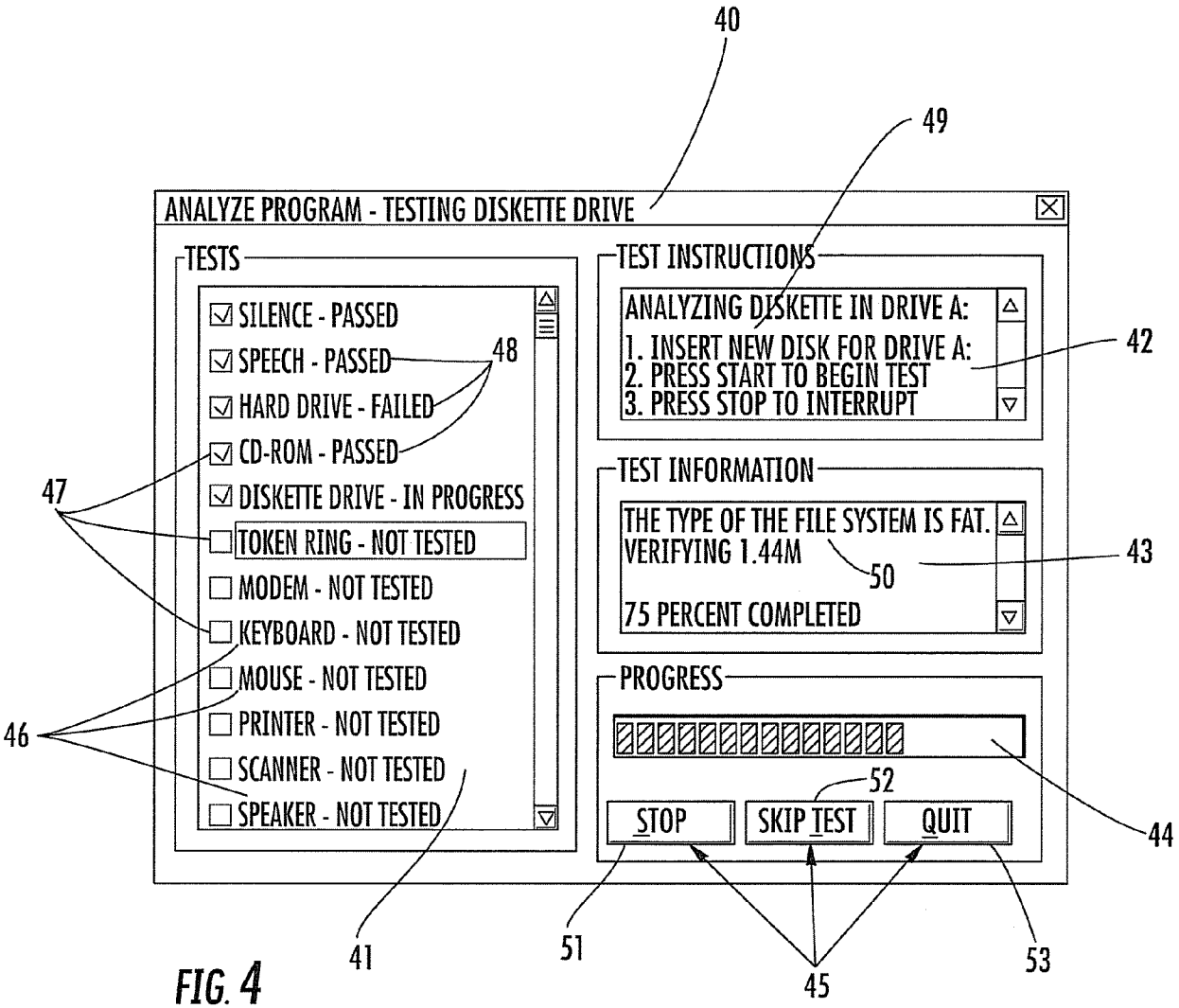
FIG. 4 is a user interface for an apparatus used to identify excess noise in a computer system.

FIG. 4 is a user interface for a system for detecting excess noise in a computer system. The user interface preferably can be a dialog box 40 for interacting with the user. As shown in the drawing, dialog box 40 preferably includes a test field 41, a test instruction text box 42, a test information text box 43, a test progress bar 44, and test control buttons 45. Test field 41 preferably includes a list of component tests 46 contained in a component test database. Each component listed preferably includes a corresponding check box 47 through which a user can select individual components for noise analysis. Finally, each component preferably indicates the status 48 of each test, that is, whether the component failed the test due to the detection of internal system noise, passed the test, or whether the test presently is in progress.

Test instruction text box 42 preferably can display test instructions associated with the selected component under test. In the drawing, for example, test instruction text box 42 shows instructions 49 to be followed by the user in testing the floppy disk drive. Test information text box 43 preferably can show detailed information relevant to the current component under test. In the drawing, for example, test information text box 43 shows information 50 relevant to the testing of the floppy disk drive. In addition, test information text box 43 can show detailed information relating to the results of the testing of the component under test. Specifically, test information text box 43 can suggest remedial measures. As shown in the drawing, test progress bar 44 shows the current relative progress of the current component under test. Finally, test control buttons 45 preferably permit the user to selectively stop the noise analysis using stop button 51. In addition, the user can skip the test for the current component under test by clicking the skip test button 52. Finally, the user can terminate the noise analysis program by clicking the quit button 53.

In sum, the preferred inventive method can measure internal system noise, taking into account the potential internal noise source in the computer system 1. Whereas present noise detection systems cannot isolate the source of internal noise, the inventive method can isolate each source of internal noise. Moreover, the present invention can both identify specific computer system component sources of the internal noise, and can recommend a remedy for the identified internal noise. Hence, the present invention can perform a thorough noise analysis resulting in an accurate diagnosis of internal noise level.

The invention claimed is:

1. A method for identifying excess noise generated by one or more internal components of a computer for a speech recognition system comprising the steps of:

recording a silence sound sample during a period of inactivity of said internal components;

performing an excess noise test for one of said internal components, said excess noise test comprising a method of operating one of said internal components to test for excess noise which interferes with a speech recognition capability of the computer system;

during said noise tests, recording a component sound sample;

comparing the signal characteristics of said silence sound sample with signal characteristics of said component sound sample; and, logging a result of the comparison of the signal characteristics of said silence sound sample and said component sound sample when said signal characteristics of said component sound sample differ by a preset threshold from said signal characteristics of said silent sound sample.

2. A method according to claim 1, further comprising the steps of:

reporting excess noise from one of said internal components in response to logging said comparison result; and, suggesting a remedy for said reported excess noise.

3. A method according to claim 2, further comprising the steps of:

generating a list of one or more internal components of said computer to be tested for excess noise;

for each of said components in said list, designating a corresponding excess noise test and a corresponding excess noise remedy.

4. A method according to claim 3, further comprising the steps of:

determining if one or more other internal components of said computer are still untested; and repeating the steps of performing, recording, comparing, logging, reporting, and suggesting for each of said other components still untested.

5. A method according to claim 1, further comprising the steps of:

generating a list of said one or more internal components of said computer to be tested for excess noise; and, for each of said components in said list, designating a corresponding excess noise test.

6. A method according to claim 5, further comprising the steps of:

determining if one or more other internal components of said computer are still untested; and repeating the steps of performing, recording, comparing, and logging for each of said other components still untested.

7. A computer-readable storage medium, having stored thereon a computer program having a plurality of code sections, said code sections executable by a computer for causing the computer to perform the steps of:

recording a silence sound sample during a period of inactivity of internal components of a computer for a speech recognition system;

executing an excess noise test for one of said internal components, said excess noise test specifying a method of operating one of said internal components to test for excess noise which interferes with a speech recognition capability of the computer system;

during said noise test, recording a component sound sample;

comparing the signal characteristics of said silence sound sample with signal characteristics of said component sound sample; and, logging a result of the comparison of the signal characteristics of said silence sound sample and said component sound sample when said signal characteristics of said component sound sample differ by a preset threshold from said signal characteristics of said silent sound sample.

8. A computer-readable storage medium according to claim 7, further comprising code sections for:

reporting excess noise from said one of said internal components in response to logging said comparison result; and, suggesting a remedy for said reported excess noise.

9. A computer-readable storage medium according to claim 8, further comprising code sections for:

generating a list of one or more internal components of said computer to be tested for excess noise;

for each of said components in said list, designating a corresponding excess noise test and a corresponding excess noise remedy.

10. A computer-readable storage medium according to claim 9, further comprising code sections for:

determining if one or more other internal components of said computer are still untested; and repeating the steps of performing, recording, comparing, logging, reporting, and suggesting for each of said other components still untested.

11. A computer-readable storage medium according to claim 7, further comprising code sections for:

generating a list of said one or more internal components of said computer to be tested for excess noise; and, for each of said components in said list, designating a corresponding excess noise test.

12. A computer-readable storage medium according to claim 11, further comprising code sections for:

determining if one or more other internal components of said computer are still untested; and repeating the steps of performing, recording, comparing, and logging for each of said other components still untested.

* * * * *